US005131784A

United States Patent [19]

Maasen

[11] Patent Number: 5,131,784

[45] Date of Patent: Jul. 21, 1992

[54] TORSION BAR CLAMP FOR BOAT LIFTS

[75] Inventor: Dennis A. Maasen, Sunrise Beach, Mo.

[73] Assignee: Hydro Systems, Inc., Sunrise Beach, Mo.

[21] Appl. No.: 624,987

[22] Filed: Dec. 10, 1990

[51] Int. Cl.[5] ..... F16B 7/04

[52] U.S. Cl. ..... 403/312; 403/313; 403/110; 403/383; 405/3; 114/44

[58] Field of Search ..... 403/313, 312, 310, 309, 403/306, 305, 308, 109, 110, 377, 344, 383, 300; 405/3; 114/44, 45

[56] References Cited

U.S. PATENT DOCUMENTS

| | | | |
|---|---|---|---|
| 1,555,847 | 10/1925 | Hudson | 403/306 |
| 1,710,842 | 4/1929 | Salustri | 403/312 |
| 2,445,543 | 7/1948 | Thines | 403/109 X |
| 3,604,734 | 9/1971 | Friedman | 403/110 X |
| 4,080,080 | 3/1978 | Cisler | 403/110 X |
| 4,397,088 | 8/1983 | Hampel | 403/312 X |
| 4,848,954 | 7/1989 | Wiseman | 403/312 |

FOREIGN PATENT DOCUMENTS

| | | | |
|---|---|---|---|
| 2640611 | 3/1978 | Fed. Rep. of Germany | 403/110 |

*Primary Examiner*—Peter M. Cuomo

*Attorney, Agent, or Firm*—Kokjer, Kircher, Bowman & Johnson

[57] ABSTRACT

A clamp mechanism for an adjustable torsion bar of a boat lift. The torsion bar includes square tubes which fit together telescopically to allow the torsion bar length to be adjusted. Each clamp mechanism includes a pair of opposing angle members lined on the inside faces of their flanges with plates which extend along a part of the length of each flange. The angle members are applied in opposition to one another with the inside faces of the flanges directly against the larger tube and the plates against the smaller tube. The angle members are clamped to the tubes by nuts and bolts applied to lugs which project from the angle members.

9 Claims, 2 Drawing Sheets 5.
5.
6.
6.

TORSION BAR CLAMP FOR BOAT LIFTS

BACKGROUND AND SUMMARY OF THE INVENTION

This invention relates generally to boat lifts and more particularly to an improved clamp mechanism for an adjustable torsion bar which forms part of a boat lift frame.

It is common practice for the frames of boat lifts to include torsion bars which extend transversely across the boat lift and provide side to side leveling. In order to accommodate boats having different widths and docks that vary in width, the torsion bars must be constructed to adjust in their length. The length adjustment is typically provided by a telescopic construction of the torsion bar in which one tube fits telescopically inside of another larger tube.

In the past, the torsion bar has been locked at the desired length by splitting the larger tube at three corners, thus providing tabs on the larger tube which may be clamped onto the smaller tube. In this manner, the tubes can be locked against telescopic extension and retraction and the clamp can be released when it is desired to adjust the length of the torsion bar. The main problem with this type of arrangement is that the tabs are susceptible to breakage, especially after the boat lift has been in service for an extended period. If the tabs break, the clamp loses holding power and the tubes can slip and cause the boat lift to lean unacceptably.

The present invention is directed to an improved clamp mechanism for clamping together the telescopic tubes of a torsion bar for a boat lift. The invention is characterized by the ability to reliably clamp the tubes together in a manner to avoid slippage and the problems that result when the tubes slip.

In accordance with the invention, the larger and smaller telescoping square tubes of a boat lift frame are clamped together by a pair of opposing angle members which are applied to the tubes adjacent to the area where the tubes meet. The inside faces of the flanges of the angle members are provided at one end with plates which fit against the sides of the smaller square tube. The opposite ends of the flanges directly engage the sides of the larger tube. Consequently, the angles can be clamped together in opposition to one another so that the tubes are locked together and prevented from slipping relative to one another.

The clamping function is provided by nut and bolt assemblies which connect U-shaped lugs that project from the angle members. Each lug is located to align with a lug on the opposing angle member so that when the nuts are tightened on the bolts, the lugs are pulled together to thus draw the angles inwardly and clamp them securely onto the tubes. The plates which line the inside faces of parts of the flanges compensate for the size difference between the larger and smaller tubes.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
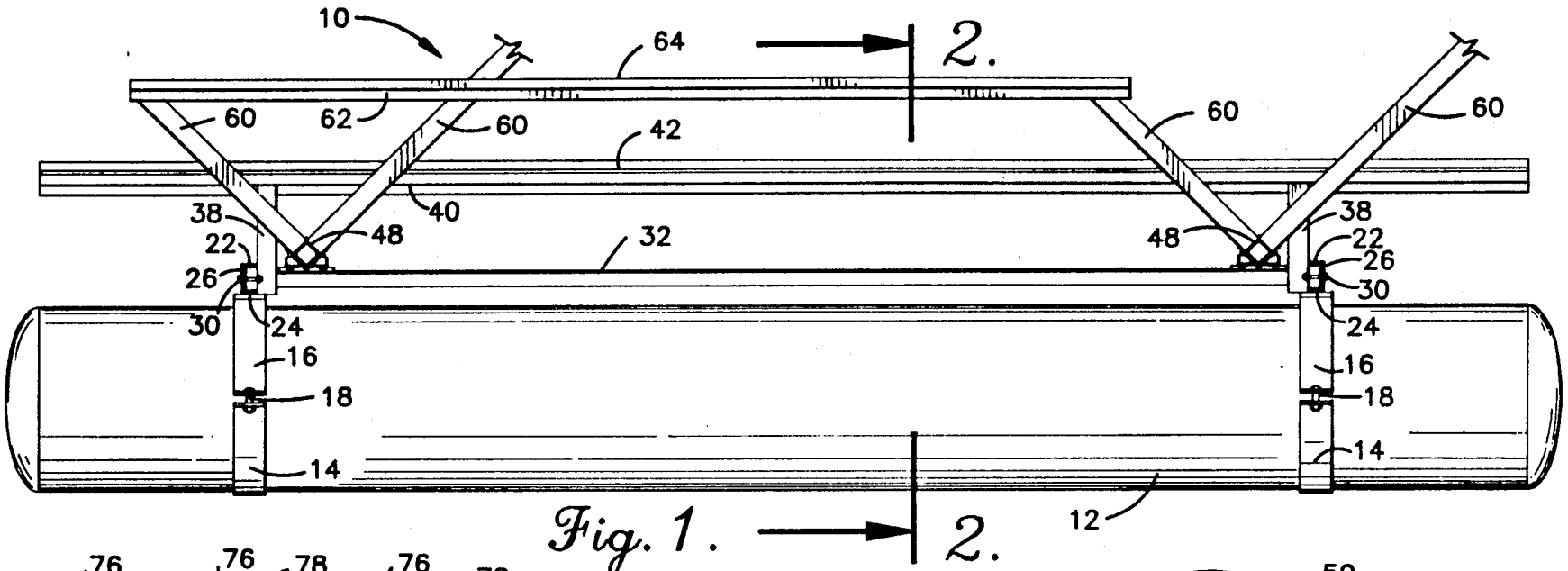
FIG. 1 is a side elevational view of a boat lift that includes a pair of torsion bars each equipped with a clamp mechanism constructed in accordance with a preferred embodiment of the present invention.
Figures 2, 3:
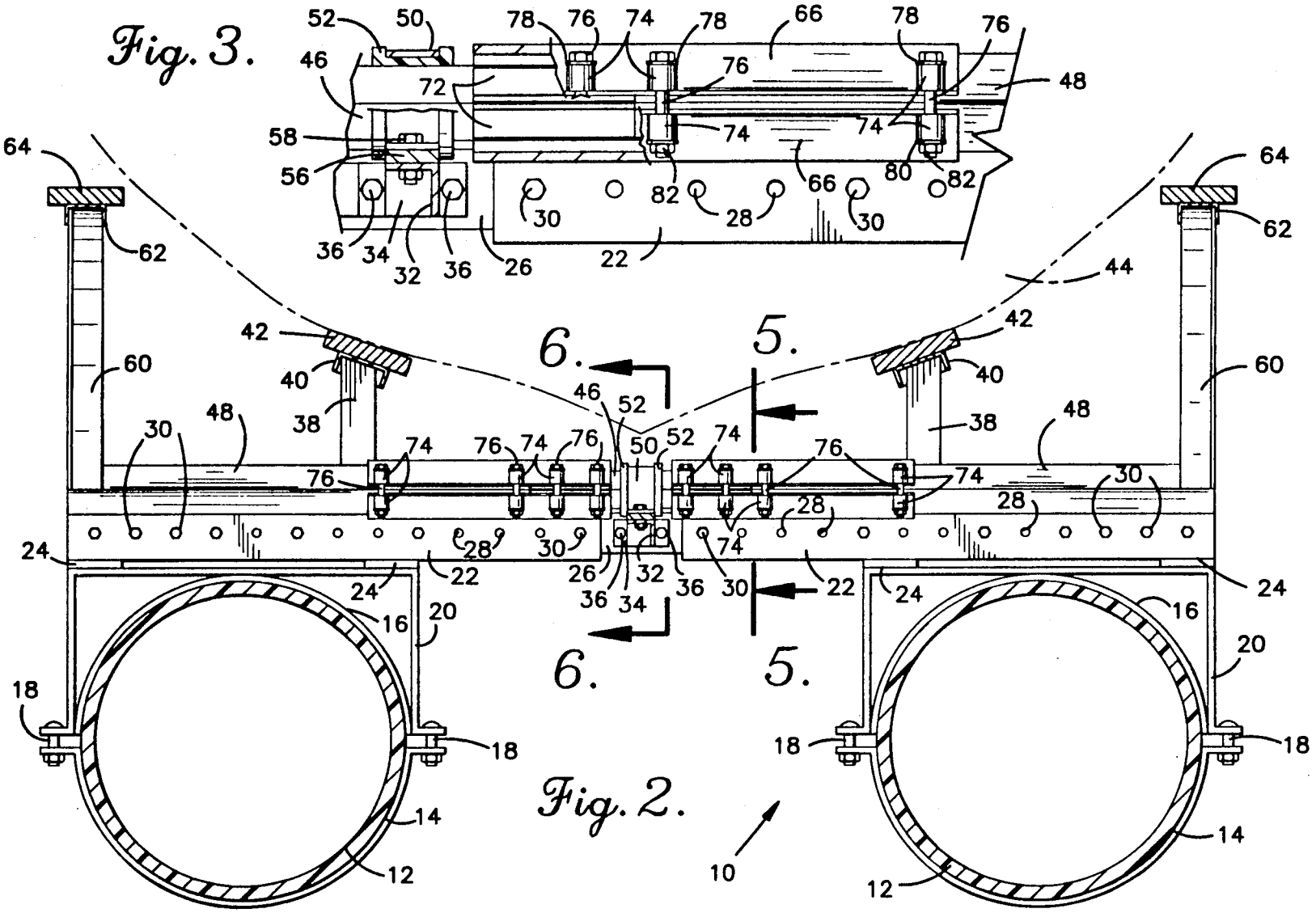
FIG. 2 is a sectional view on an enlarged scale taken generally along line 2—2 of FIG. 1 in the direction of the arrows.
FIG. 3 is a fragmentary elevational view of one of the torsion bars on an enlarged scale, with portions broken away for purposes of illustration.

Referring now to the drawings in more detail and initially to FIGS. 1 and 2 in particular, a boat lift is generally identified by numeral 10. The boat lift 10 includes a pair of pontoons 12. Extending around each of the pontoons 12 near their opposite ends are semicircular bands 14 and 16 which are bolted together at their mating ends by bolts 18. Each of the upper bands 16 is connected with a bracket 20. Secured on each bracket 20 is a rigid channel 22 having flat mounting flanges 24 which are bolted or otherwise secured to the flat top portion of bracket 20. The channels 22 are arranged in axially aligned pairs, with one pair being located near one end of the pontoons 12 and the other pair being located near the opposite end of the pontoons 12.

The channels 22 in each aligned pair are fitted on and secured to the opposite end portions of a smaller channel 26, thus connecting the pontoons 12 near their front and back ends. Each channel 22 is provided with a plurality of bolt holes 28 which align with mating bolt holes in channel 26. Nut and bolt fasteners 30 are fitted through the aligned bolt holes in order to secure the channels together. The fasteners 30 may be removed to permit channels 22 to be slid inwardly or outwardly on the smaller channel 26, thus adjusting the distance between the pontoons 12 and the overall width of the boat lift.

Figure 6:
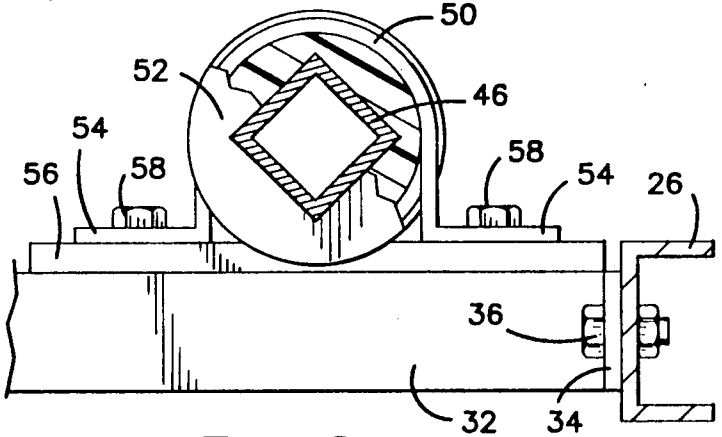
FIG. 6 is a fragmentary sectional view on an enlarged scale taken generally along line 6—6 of FIG. 2 in the direction of the arrows, with a portion broken away for purposes of illustration.

The two channels 26 are connected near their ends by tubular frames (not shown) and at their centers by a longitudinal angle member 32 which extends along the longitudinal center line of the boat lift 10. As shown in FIGS. 3 and 6, the opposite ends of the angle 32 are welded or otherwise connected to end plates 34 which are bolted at 36 to the channels 26. The angle member 32 thus ties together the two channel assemblies located near the opposite ends of the boat lift. Extending upwardly from each channel 22 is a rigid leg 38. Mounted on the top end of each leg 38 is an angle member 40. The angle members 40 for the legs 38 on each side of the boat lift are provided with tubes for connection to an elongated pad 42. The two pads 42 are generally parallel to one another and extend longitudinally along substantially the entire length of the boat lift. The pads 42 are inclined slightly in order to receive the hull 44 (see FIG. 2) of a boat.

In accordance with the present invention, a transverse torsion bar is located near each of the channel assemblies to provide side to side leveling. Each of the torsion bars takes the form of telescoping square tubes, including a relatively small square tube 46 and two larger square tubes 48 which are fitted telescopically on the opposite ends of the tube 46. The inside profile of each larger tube 48 is slightly larger than the outside profile of tube 46 to provide a relatively close telescopic fit between the tubes.

As best shown in FIG. 6, each tube 46 extends through a U-shaped bracket 50 and through a flanged bushing 52 having a square opening which closely receives tube 46. Flanges 54 projecting from each bracket 50 seat on a plate 56 which extends on top of the angle 32. Nut and bolt assemblies extend through the flanges 54, plate 56 and the upper flange of angle 32, thus securing bushing 52 and tube 46 on angle 32. In this manner, each of the relatively small square tubes 46 is mounted at a location adjacent to one of the channels 26.

As previously indicated, each tube 46 receives a pair of larger tubes 48 which fit closely on tube 46 in a telescopic manner and which extend in opposite directions. The torsion bar which is formed by each tube 46 and the two tubes 48 which fit on it extends transversely across the entire width of the boat lift 10 and is adjustable in length by telescopically extending or retracting the larger tubes 48.

The outer end of each of the larger tubes 48 is provided with a pair of rigid angle members 60 which are arranged in the configuration of a V, as best shown in FIG. 1. On each side of the boat lift, two of the angles 60 carry square tubes 62 on their upper ends, and the channel brackets 62 in turn carry rigid boards 64 which extend lengthwise at locations outwardly of the lower pads 42. The other angles 60 are for connection to a dock.

In accordance with the present invention, the telescoping tubes 46 and 48 of each torsion bar may be clamped together by special clamping mechanisms, each of which includes a pair of angle members 66 constructed similarly to one another. Each angle member 66 has a pair of mutually perpendicular flanges 68 having substantially the same width as the sides of the larger square tube 48. Each flange 68 has an inside face 70 which is disposed in contact with one of the outer faces of the larger tube 48 when the angles 66 are applied to the torsion bar. When the two angle members 66 are applied to the larger tube 48 in opposition to one another, the inside faces 70 of flanges 68 fit against the outer faces of the four sides of the square tube 48.

Figure 5:
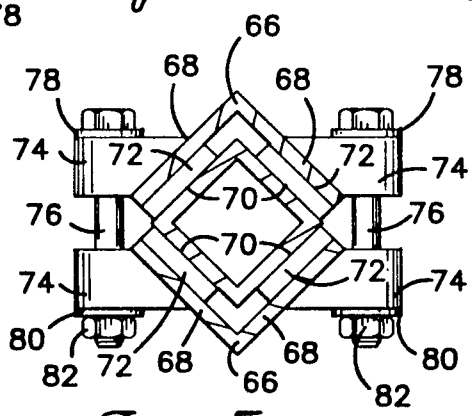
FIG. 5 is a fragmentary sectional view on an enlarged scale taken generally along line 5—5 of FIG. 2 in the direction of the arrows.
Figure 4:
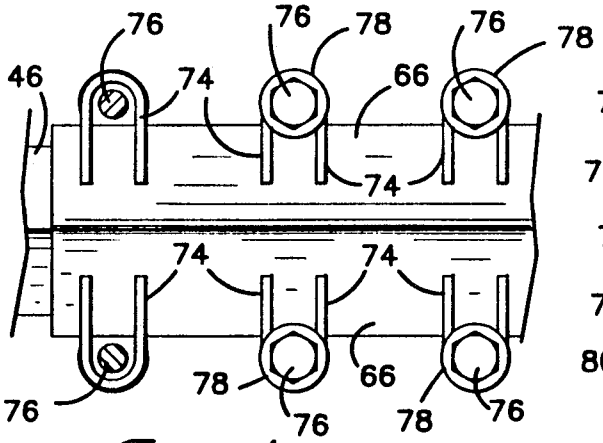
FIG. 4 is a fragmentary top plan view showing the clamp mechanism of the present invention applied to one of the torsion bars.

Because of the smaller size of the tube 46, each inside face 70 is provided with a plate 72 at location adjacent to one end of each angle member 66. The plates 72 may be welded or otherwise secured to the flanges 68. Each plate 72 has a thickness such that it fits against the outside face of one side of tube 46 while the face 70 itself fits against the corresponding face of the outer tube 48. As shown in FIG. 5, when the angle members 66 are applied to the torsion bar, the plates 72 fit against the four outer faces of tube 46.

Each of the torsion bars is provided with two of the clamping mechanisms in order to permit each of the larger tubes 48 to be clamped to the smaller tube 46. In order to permit the angle members 66 to be clamped securely against the tubes 46 and 48, each flange 68 is provided with four U-shaped lugs 74 which are welded to the outside surfaces of the flanges 68 and which project from the angle member 66. The plates 72 extend for only a selected part of the length of each angle member, and the portion of each flange 68 to which a plate 72 is secured is provided with two of the lugs 74. The remaining portion of the length of each flange is devoid of an inside plate and is provided with two of the lugs 74. The lugs 74 are located such that one lug on each angle member 66 aligns with one of the lugs on the opposing angle 66, and the lugs project on opposite sides of each angle 66.

A bolt 76 is extended through the lugs 74 of each aligned pair with a washer 78 fitting against the upper lug 74 beneath the head of the bolt 76. Another washer 80 is fitted on the lower end of each bolt 76 and is engaged by a nut 82 which is threaded onto the end of each bolt 76.

The nuts 82 may be loosened in order to relieve the clamping force on the angles 66, and when all of the nuts are loosened, each of the larger tubes 48 may be extended or retracted telescopically on the smaller tube 46. Consequently, the length of each torsion bar can be adjusted by sliding tubes 48 inwardly or outwardly as desired to accommodate adjustment of the width of the boat lift 10.

When the torsion bars have been adjusted as desired, the angle members 66 are located such that they extend around the areas where the tubes 48 meet the tube 46, with the plates 72 confronting the smaller tube 46 and the inside faces 70 of flanges 68 confronting the larger tube 48. When the nuts 82 are subsequently tightened, the opposing lugs 74 are pulled toward one another in order to draw the opposing angles 66 toward one another, thus securely clamping plates 72 on tube 46 and faces 70 on tube 48. The clamping force provided by the nut and bolt assemblies clamps tubes 48 securely in place to prevent telescoping adjustment of tubes 46.

It is noted that the plates 72 present relatively large surface areas which engage all four of the outside faces of tube 46, thus distributing the clamping force over a large surface to prevent any points of stress concentration. Similarly, the faces 70 engage the four outside surfaces of tube 48 over a large area and thus distribute the stresses caused by the clamping force. The lack of stress concentration avoids breaking any part of the clamping assembly or the telescoping tubes while assuring that the clamping force is sufficient to prevent the tubes from inadvertently slipping. At the same time, the clamps can be released in a quick and simple manner by loosening the nuts 82 and subsequently tightening them again once the torsion bar length has been adjusted appropriately.

The outside dimension of each larger tube 48 may be 2½ inches, and the outside dimension of each smaller tube may be 2 inches. If the wall thickness of the larger tube is 3/16 inch, there is ⅛ inch of "slop" between the two tubes when they are fitted together. Preferably, the plates 72 on one angle member 66 of each pair are 5/16 inch thick and the plates 72 on the other angle member 66 of each pair are 3/16 inch thick. With these plate thicknesses, two walls of the smaller tube are held snugly against two corresponding walls of the larger tube in order to resist relative rotation of the tubes.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations.

This is contemplated by and is within the scope of the claims.

Since many possible embodiments may be made of the invention without department from the scope thereof, it is to be understood that all matter herein set forth or shown in the accompanying drawings is to be interpreted as illustrative and not in a limiting sense.

Having thus described the invention, I claim:

1. In a torsion bar for the frame of a boat lift, the combination of:

a pair of rigid tubes each having four planar faces, said tubes including a smaller tube and a larger tube fitting telescopically on the smaller tube for telescopic extension and retraction to adjust the torsion bar length;

a pair of angle members for releasably clamping said tubes together, each angle member having a pair of flanges each presenting an inside face;

a plate secured on the inside face of each flange to extend along a selected portion of the length thereof, said plates having thicknesses to allow the angle members to be applied to said tubes with said inside faces of the flanges engaging the respective faces of the larger tube and said plates engaging the respective faces of the smaller tube; and releasable means for clamping said angle members together to clamp said tubes together.

2. The combination of claim 1, wherein each tube is substantially square in section.

3. The combination of claim 1, wherein said selected portion of the length of each inside face is adjacent to one end thereof.

4. The combination of claim 1, wherein said releasable clamping means comprises:

a plurality of projections on each angle member, each projection located to align with an opposing projection on the other angle member when the angle members are applied to the tubes; and a plurality of releasable fasteners for extension between the opposing pairs of projections, each fastener having a tightened condition wherein the angle members are clamped to the tubes and a released condition wherein the angle members are released to allow telescopic extension and retraction of the tubes.

5. A torsion bar assembly for a boat lift frame, said assembly comprising:

a first square tube secured to the boat lift frame and having four faces;

a second square tube fitting telescopically on said first tube to extend and retract telescopically relative thereto, said second tube having four faces and carrying means thereon for receiving a boat hull;

a pair of angle members each having a pair of flanges, each flange having an inside face;

a plate secured to the inside face of each flange and extending along a selected portion of the length thereof, said plates having thicknesses to allow the angle members to be applied to said tubes in opposition to one another with said inside faces of the flanges confronting the respective faces of the second tube and said plates confronting the respective faces of the first tube;

means for clamping said angle members together to lock said inside faces of the flanges against the respective faces of the second tube and said plates against the respective faces of the first tube, thereby locking the tubes against telescopic extension or retraction.

6. The assembly of claim 5, wherein said selected portion of the length of each inside face is adjacent to one end thereof.

7. The assembly of claim 5, wherein said clamping means comprises:

a plurality of projections on each angle member, each projection located to align with an opposing projection on the other angle member when the angle members are applied to the tubes; and a plurality of releasable fasteners for extension between the opposing pairs of projections, each fastener having a tightened condition wherein the angle members are clamped to the tubes and a released condition wherein the angle members are released to allow telescopic extension and retraction of the tubes.

8. A clamp mechanism for a boat lift torsion bar having larger and smaller square tubes telescopically interfitting for extension and retraction, said clamp mechanism comprising:

a pair of angle members for clamping the tubes together, each angle member having a pair of flanges each presenting an inside face;

a plate secured to the inside face of each flange and extending along only a portion of the length thereof, said plates having thicknesses to engage said smaller tube while the inside faces of said flanges engage said larger tube upon application of said angle members to the tubes in opposition to one another;

a plurality of projections on each angle member;

a plurality of releasable fasteners for securing the projections of the opposing angle members together in a manner to clamp the angle members on the tubes, thereby locking the tubes against extension and retraction.

9. The clamp mechanism of claim 8, wherein said portion of the length of each inside face is located adjacent to one end thereof.

* * * * *